US010549323B2

(12) United States Patent
Sugita et al.

(10) Patent No.: US 10,549,323 B2
(45) Date of Patent: Feb. 4, 2020

(54) WATER JET PEENING METHOD

(71) Applicant: SUGINO MACHINE LIMITED, Uozu, Toyama Prefecture (JP)

(72) Inventors: Koji Sugita, Uozu (JP); Shunji Otani, Uozu (JP)

(73) Assignee: SUGINO MACHINE LIMITED, Uozu, Toyama Prefecture (JP)

( * ) Notice: Subject to any disclaimer, the term of this patent is extended or adjusted under 35 U.S.C. 154(b) by 39 days.

(21) Appl. No.: 15/822,976

(22) Filed: Nov. 27, 2017

(65) Prior Publication Data

US 2018/0236463 A1 Aug. 23, 2018

(30) Foreign Application Priority Data

Feb. 23, 2017 (JP) ..... 2017-032349

(51) Int. Cl.

| | |
|---|---|
| ***B08B 3/04*** | (2006.01) |
| ***B05B 1/02*** | (2006.01) |
| ***B05B 1/34*** | (2006.01) |
| ***B24C 1/10*** | (2006.01) |
| ***C21D 7/06*** | (2006.01) |
| *C22F 1/04* | (2006.01) |

(52) U.S. Cl.

CPC ..... *B08B 3/04* (2013.01); *B05B 1/02* (2013.01); *B05B 1/34* (2013.01); *B24C 1/10* (2013.01); *C21D 7/06* (2013.01); *C22F 1/04* (2013.01)

(58) Field of Classification Search

CPC combination set(s) only.
See application file for complete search history.

(56) References Cited

U.S. PATENT DOCUMENTS 3,020,140 A * 2/1962 Bluth ..... B24C 11/00 51/306
6,855,208 B1 * 2/2005 Soyama ..... B24C 1/10 134/1

(Continued)

FOREIGN PATENT DOCUMENTS

CN 103014277 A 4/2013
EP 2878686 A2 6/2015

(Continued)

OTHER PUBLICATIONS

Katsuhiko Hirano, et.al., "Effects of Water Jet Peening on Corrosion Resistance and Fatigue Strength of Type 304 Stainless Steel," "Materials," Jul. 1996, pp. 740-745, vol. 45, No. 7, Journal of the Society of Materials Science, Japan.

(Continued)

*Primary Examiner* — Erin F Bergner
(74) *Attorney, Agent, or Firm* — United IP Counselors, LLC

(57) ABSTRACT

A simple water jet peening method is usable for a smaller device, and allows use of an existing underwater washing machine. The method includes immersing an object in a water based washing liquid in a washing bath to have a processing surface at a distance of at least 100 mm and less than 300 mm from a liquid surface of the water based washing liquid, and jetting the water based washing liquid from a nozzle downward toward the object in the water based washing liquid contained in the washing bath.

6 Claims, 5 Drawing Sheets

(56) References Cited

U.S. PATENT DOCUMENTS

| | | | | |
|---|---|---|---|---|
| 2004/0081849 | A1* | 4/2004 | Westre | B32B 15/14 428/687 |
| 2009/0056399 | A1 | 3/2009 | Hatou et al. | |
| 2011/0179844 | A1 | 7/2011 | Hennig et al. | |
| 2013/0074561 | A1 | 3/2013 | Alberts et al. | |
| 2015/0151405 | A1 | 6/2015 | Maeguchi et al. | |

FOREIGN PATENT DOCUMENTS

| | | | |
|---|---|---|---|
| JP | H4-362124 | A | 12/1992 |
| JP | H07-328855 | A | 12/1995 |
| JP | H07-328859 | A | 12/1995 |
| JP | H7-328860 | A | 12/1995 |
| JP | 2840027 | B2 | 12/1998 |
| JP | 2991545 | B2 | 12/1999 |
| JP | 3162104 | B2 | 4/2001 |
| JP | 2003-145357 | A | 5/2003 |
| JP | 2009-090443 | A | 4/2009 |
| JP | 2016-079889 | A | 5/2016 |

OTHER PUBLICATIONS

Extended European Search Report dated Jun. 28, 2018 in the corresponding European patent application No. 17207301.7, 9 pp.
Office Action dated Feb. 22, 2019 in the corresponding Korean patent application No. 10-2017-0155296 (4 pages).

* cited by examiner

A

B

C

WATER JET PEENING METHOD

CROSS-REFERENCE TO RELATED APPLICATIONS

This application claims the benefit of priority to Japanese Patent Application No. 2017-032349, filed on Feb. 23, 2017, the entire contents of which are hereby incorporated by reference.

BACKGROUND

1. Technical Field

The present invention relates to a water jet peening method.

2. Description of the Background

One known technique for hardening the surface of a metal workpiece is shot peening, which causes small steel balls (shots) to collide against the surface of a workpiece to impart compressive residual stress in the surface. Another known technique is water jet peening, which uses an impulsive force from cavitation generated by a cavitation jet (refer to, for example, Japanese Patent No. 2991545 or hereafter Patent Literature 1, and Japanese Patent No. 3162104 or hereafter Patent Literature 2).

Water jet peening uses an impulsive force generated from the collapse of cavitation bubbles. A fluid undergoes a decrease in pressure as its speed increases, thus forming bubbles. As the liquid pressure recovers, the growing bubbles contract and collapse to generate the impulsive force. Water jet peening thus uses no processing material other than the liquid, and also eliminates post-processing, such as separating, collecting, and washing shots.

Water jet peening can be used to process complex-shaped surfaces with narrow portions, which are typically difficult to process using shots. Although impacting using shots provides an entirely roughly processed surface with large recesses or peening dents conforming to the contour of shots used on the surface, water jet peening provides an entirely smooth surface with recesses having smaller diameters that are smoothly continuous with the surrounding area with no clear boundary. Water jet peening is also used to improve the residual stress in a reactor pressure vessel (refer to, for example, Japanese Unexamined Patent Application Publication No. 7-328860 or hereafter Patent Literature 3, and Japanese Patent No. 2840027 or hereafter Patent Literature 4).

BRIEF SUMMARY

A known technique for water jet peening uses high-pressure water at 60 to 70 MPa jetted from a nozzle downward into a liquid, forming a strong cavitation jet. The processing surface of a workpiece is often at a sufficiently large distance of about 600 mm or 1.5 m from the liquid surface ("Effects of Water Jet Peening on Corrosion Resistance and Fatigue Strength of Type 304 Stainless Steel," Journal of the Society of Materials Science, Japan, "Materials," Vol. 45, No. 7, pp 740-745, July 1996, or hereafter Non-Patent Literature 1), or at a smaller distance of, for example, 300 mm, as described in Patent Literatures 1 and 2. This facilitates cavitation by preventing the high-pressure jet from drawing in air from the liquid surface.

Water jet peening uses a water tank deeper than the depth at which a processing portion is arranged. This upsizes the devices used for peening.

After machining, a cut metal workpiece is washed with a washing liquid jetted onto the workpiece to remove chips and other matter. For this process, an underwater washing machine jets, through a jet nozzle positioned above, a high-pressure washing liquid supplied from a tank toward the workpiece in a washing bath.

The washed workpiece then undergoes water jet peening that imparts compressive residual stress. The peening process following the washing process, if performed using the same underwater washing machine without moving the workpiece, would greatly increase the work efficiency. However, the existing underwater washing machine is too small to use such a known technique of water jet peening.

One or more aspects of the present invention are directed to a simple water jet peening method usable for a smaller device, and allowing use of an existing underwater washing machine.

A water jet peening method according to one or more embodiments includes:

immersing an object in a water based washing liquid in a washing bath to have a processing surface at a distance of at least 100 mm and less than 300 mm from a liquid surface of the water based washing liquid; and jetting the water based washing liquid from a nozzle downward toward the object in the water based washing liquid contained in the washing bath.

The water jet peening method according to the embodiments of the present invention allows water jet peening on a processing surface at a shorter distance from a liquid surface than with a known method, and thus allows water jet peening to use an underwater washing machine for washing a machine part and improves the work efficiency.

DETAILED DESCRIPTION

Figure 1:
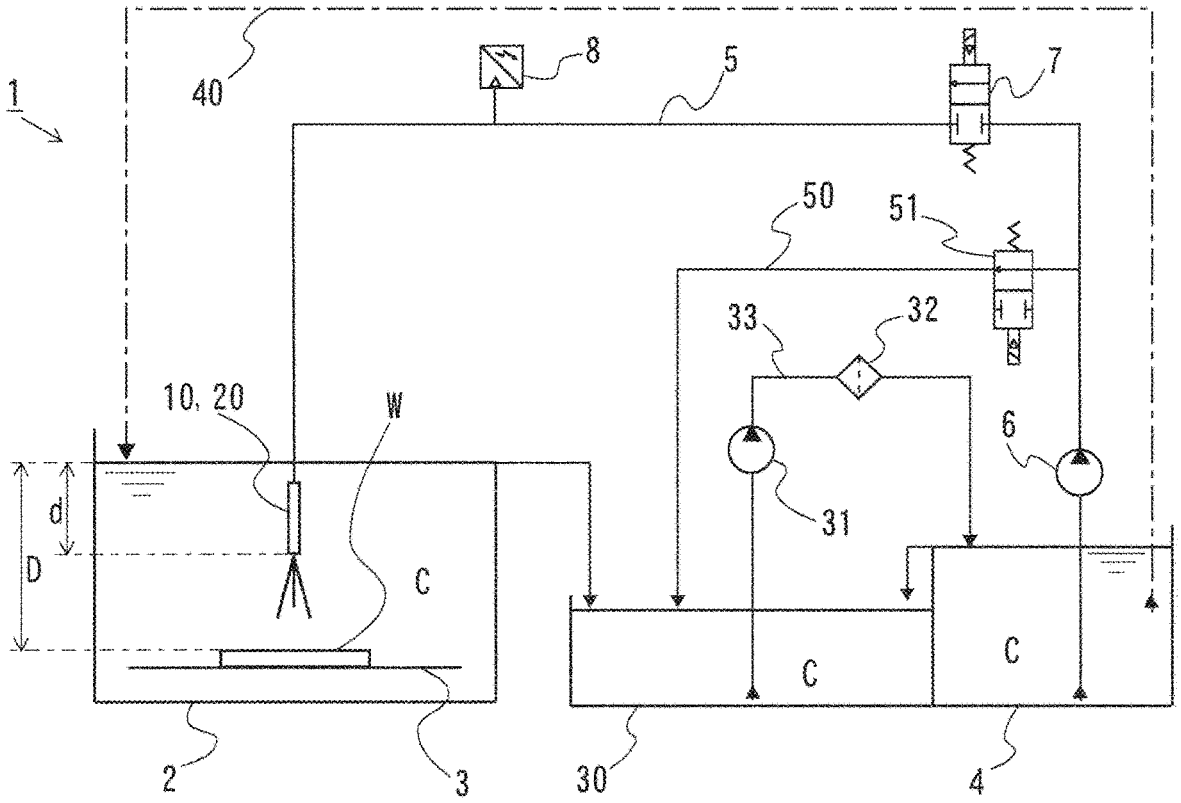
FIG. 1 is a schematic diagram of an example underwater washing machine for water jet peening according to an embodiment.
Figure 2A:
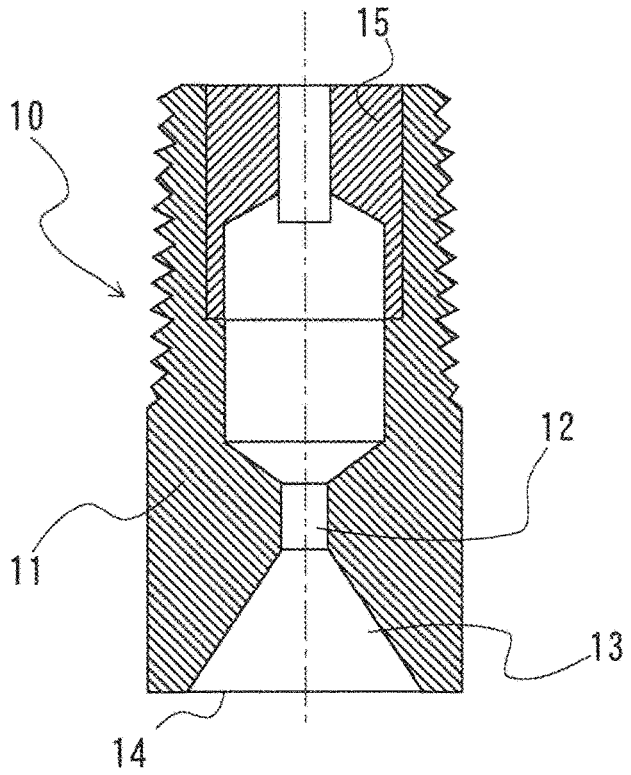
FIG. 2A is a schematic sectional view of a horn jet nozzle including a flow straightener.
Figure 2B:
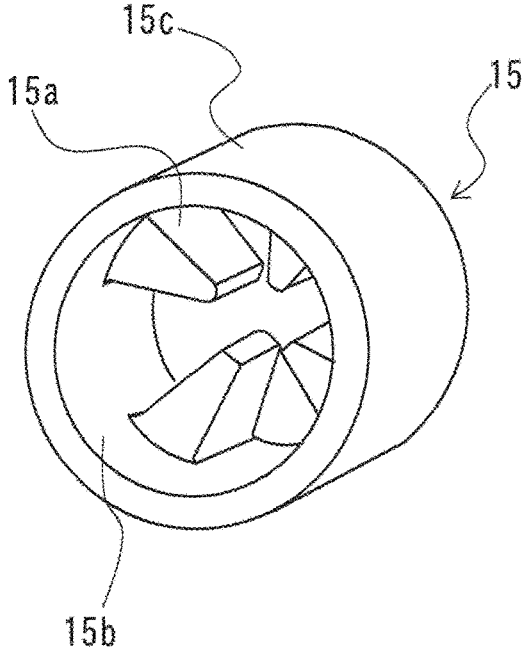
FIG. 2B is a perspective view of the flow straightener viewed from its downstream end.
Figure 3:
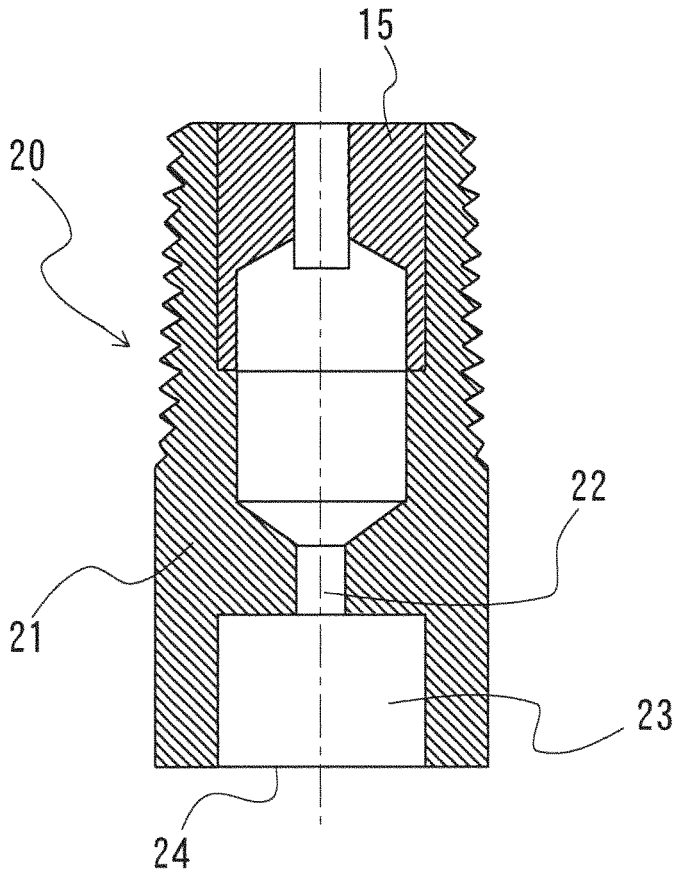
FIG. 3 is a schematic sectional view of a wide jet nozzle.
Figure 4:
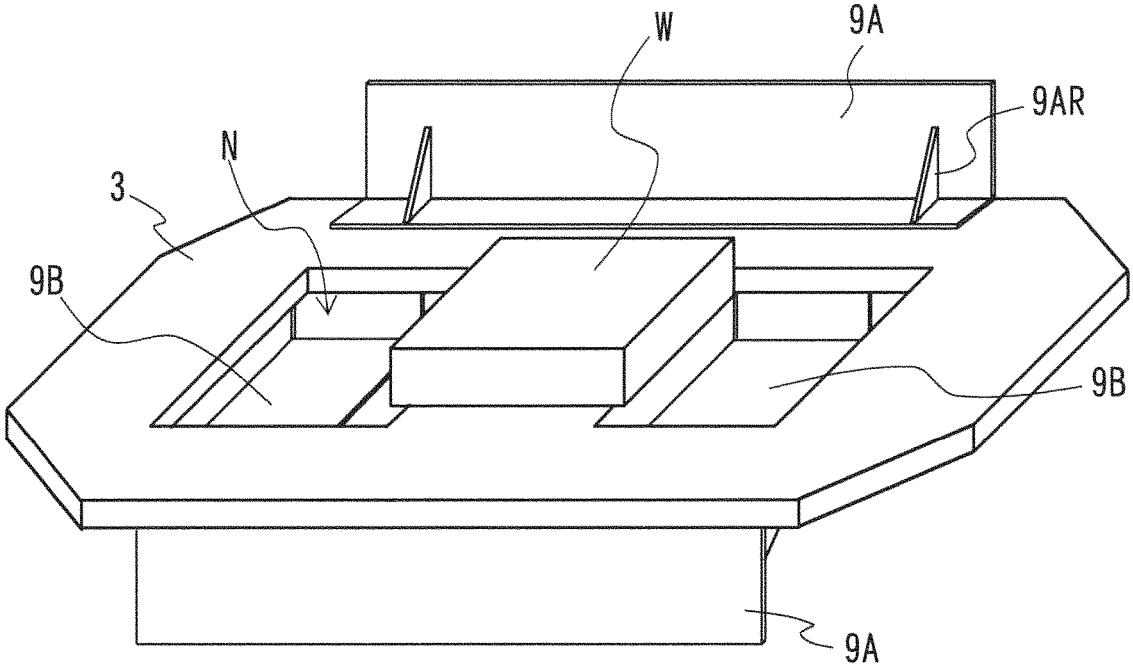
FIG. 4 is a perspective view of a table on which a circulation obstruction is mounted.

FIG. 1 shows an underwater washing machine implementing a water jet peening method according to one or more embodiments. FIG. 1 is a schematic side sectional view of the underwater washing machine. FIGS. 2A to 3 are schematic views of a jet nozzle attached to the underwater washing machine shown in FIG. 1. FIG. 2A is a schematic sectional view of a horn nozzle. FIG. 2B is a perspective view of a flow straightener arranged upstream in a nozzle body as viewed from its downstream end. FIG. 3 is a schematic sectional view of a wide nozzle. FIG. 4 is a perspective view of a table placed inside the washing bath shown in FIG. 1 on which an object W is to be mounted and fixed, and baffles attached to the table to obstruct circulation of the washing liquid.

An underwater washing machine 1 includes a washing bath 2, a washing liquid tank 4, and a recovery tank 30. The washing bath 2 contains a washing liquid C, in which an object W, such as a machine part to be processed, is to be mounted. The washing liquid tank 4 is a source of the washing liquid C. The recovery tank 30 receives the used washing liquid C. The washing liquid C is supplied from the washing liquid tank 4 to the washing bath 2 through a bath-washing liquid supply channel 40.

A jet nozzle 10 is placed above the washing bath 2 in a vertically movable manner. The jet nozzle 10 is adjustable to have its lower end injection port 14 at an intended vertical position. A piston pump 6 pumps a high-pressure washing liquid through a washing liquid supply channel 5 and a washing liquid supply valve 7 to the jet nozzle 10. A pressure transducer 8 is arranged on the washing liquid supply channel 5. A controller (not shown) adjusts the pressure based on the measured pressure.

A drain channel 50, which branches off from the washing liquid supply channel 5, allows the washing liquid to directly flow to the recovery tank 30 from the washing liquid tank 4 through a drain valve 51. The used washing liquid C recovered into the recovery tank 30 is then pumped up by a centrifugal pump 31 into a recovery channel 33, passes through a filter 32 to remove impurities, and then returns to the washing liquid tank 4.

The washing liquid supply valve 7 is a normally closed single solenoid valve. The drain valve 51 is a normally open single solenoid valve. These solenoid valves are driven in response to commands from the controller to control the pumps in a cooperative manner and to control jetting of the washing liquid.

The object W is mounted and fixed on a table 3, and is placed into and out of the washing bath 2 by driving the table 3. The table 3 moves the object W relative to the water jet from the jet nozzle 10 during a peening process. The controller relatively moves the table 3 in cooperation with the washing liquid jetted from the jet nozzle 10.

As shown in FIG. 2A, the jet nozzle 10 includes a nozzle body 11, which includes a choke 12 and a nozzle bore 13. The choke 12 has a uniform diameter and extends downstream from a channel that tapers downward. The nozzle bore 13 flares to have its diameter increasing from the downstream end of the choke 12. The nozzle bore 13 diverges from the center axis at an angle of 15 to 30 degrees. During underwater jetting, the jet nozzle 10 with the nozzle bore 13 produces a jet having a streamline diverging in a flared manner, thus generating turbulence around the jet and facilitating cavitation in the jet.

The jet nozzle 10 shown in FIG. 2A may be replaced by a jet nozzle 20 shown in FIG. 3 having a nozzle bore with a different shape. The jet nozzle 20 includes a nozzle body 21 with a cylindrical nozzle bore 23, which has a uniform diameter increased greatly from the diameter of a choke 22 and extends uniformly from the downstream end of the choke 22 to an injection port 24. The nozzle bore 23 may have a diameter three to five times the diameter of the choke 22. The nozzle bore 23 may have a length one to three times the length of the choke 22. During underwater jetting, the jet nozzle 20 with the nozzle bore 23 produces a jet having a streamline diverging rapidly, thus generating turbulence around the jet and facilitating cavitation in the jet. The jet nozzle 20 is described in, for example, Japanese Unexamined Patent Application Publication No. 5-212317.

The jet nozzle 10 may also include a flow straightener 15 upstream in the nozzle body 11 or 21. The flow straightener 15 includes a cylindrical frame body 15*c* and protrusions 15*a* on the inner surface of the frame body 15*c*. The protrusions 15*a* each have a substantially V-shaped cross section. The body 15*c* may have an inner diameter of at least 80% and less than 100% of its outer diameter. The protrusions 15*a* are arranged upstream in the body 15*c*. Each protrusion 15*a* may have a height of at least 30% and not more than 45% of the inner diameter of the body 15*c*. Each protrusion 15*a* may have a length in the axial direction of the body 15*c* of at least 30% and not more than 60% of the length of the body 15*c*. The flow straightener 15 includes a cylindrical flow straightening chamber 15*b* with no protrusions downstream in the body 15*c*. Examples of the flow straightener 15 include flow straighteners described in Japanese Unexamined Patent Application Publication Nos. 2016-56834 and 2006-122834.

As shown in FIG. 4, circulation obstructions 9, which obstruct circulation of the washing liquid C inside the washing bath 2, are arranged to surround an object W. Each circulation obstruction 9 may be arranged on the table 3 or on the inner wall of the washing bath 2. When the table 3 has large cutouts N, baffles 9B may be arranged on the projected plane of the cutouts N viewed in the jetting direction of the jet nozzle 10 to serve as the circulation obstructions 9. The baffles 9A arranged vertically on the mount surface of the table 3 may serve as the circulation obstructions 9. Each baffle 9A may have reinforcing ribs 9AR.

When the jet nozzle 10 immersed in the washing liquid C in the washing bath 2 jets the washing liquid C, the washing liquid C stored in the washing bath 2 circulates while agitated in the washing bath 2. As the jet pressure increases, the washing liquid C circulates intensively while agitated, causing large waves on the liquid surface of the washing liquid C in the washing bath 2. The liquid surface of the washing liquid C with large waves can obstruct cavitation. The washing liquid seems to circulate and wave more as the liquid surface of the washing liquid C is nearer the object W, drawing air into and around the jet produced by the jet nozzle 10.

The circulation obstructions 9 placed in the washing bath 2 prevent the liquid surface from waving when the jet nozzle 10 produces a jet of the washing liquid C inside the washing liquid C in the washing bath 2. This seems to increase the effect produced by water jet peening by accelerating cavitation in the water jet from the jet nozzle 10.

The circulation obstructions 9 may be fixed to a nozzle block or a nozzle attachment pipe (not shown) to which the nozzle body 11 is attached. The circulation obstructions 9 are immersed in the washing liquid C in the washing bath 2 when the nozzle body 11 jets the washing liquid C.

Examples

Examples of water jet peening using the underwater washing machine shown in FIG. 1 will now be described. In the examples, a deep water tank was first filled with fresh water up to a depth of 500 mm from the liquid surface to the processing surface, which is equal to a depth with a known technique, and to a depth of 200 mm, which is smaller than a depth with a known technique. Flat plates of aluminum (A5052) and steel (S50C) as objects W then underwent water jet peening tests using downward jetting from a horn jet nozzle 10 shown in FIG. 2A with no flow straightener shown in FIG. 2B at jet pressures of 15, 27, and 35 MPa, which are lower than a jet pressure with a known technique. Table 1 shows the rating results based on peening dents left on the processing surfaces.

Figure 5:
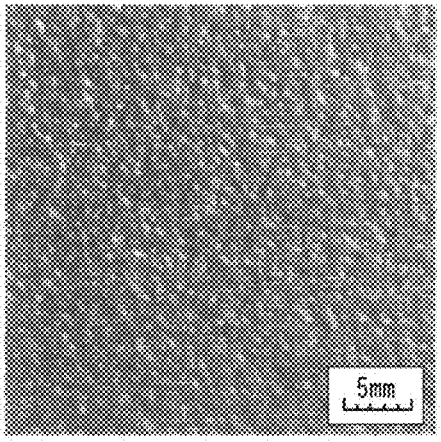
FIG. 5 are photographs showing the criteria for ratings A, B, and C in water jet peening tests.
Figure 5:
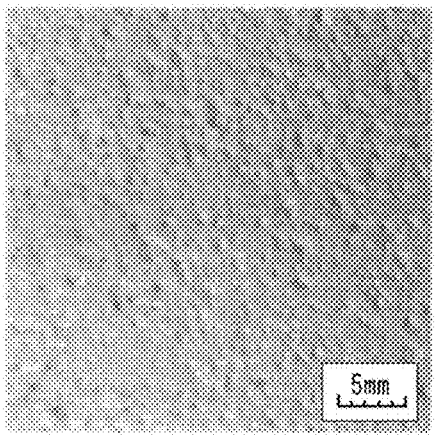
Figure 5:
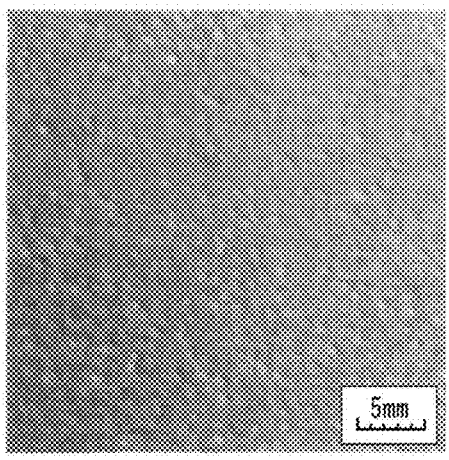

The peening performance was rated in the manner illustrated schematically in FIG. 5. The peening performance is rated A, showing high peening performance, when the processing surface has peening dents observed densely and evenly across the entire area. The peening performance is rated B when the processing surface has peening dents observed less densely than on the surface rated A. The peening performance is rated C when the processing surface has sparse and shallow peening dents. The peening performance is rated D when the processing surface has fewer and smaller peening dents or less visible peening dents (not shown).

TABLE 1

| Test No. | Object (material) | Pressure (MPa) | Flow rate (L/min) | Nozzle type and diameter ø (mm) | Processing surface depth D (mm) | Nozzle depth d (mm) | Washing liquid | Rating |
|---|---|---|---|---|---|---|---|---|
| 1 | Aluminum | 15 | 14.5 | Horn nozzle 2.0 | 500 | 100 | Fresh water | A |
| 2 | Aluminum | 27 | 19.4 | Horn nozzle 1.6 | 500 | 100 | Fresh water | A |
| 3 | Aluminum | 35 | 22.1 | Horn nozzle 1.6 | 500 | 100 | Fresh water | A |
| 4 | Aluminum | 35 | 22.1 | Horn nozzle 1.6 | 200 | 100 | Fresh water | A |
| 5 | Steel | 35 | 22.1 | Horn nozzle 1.6 | 500 | 100 | Fresh water | D |
| 6 | Steel | 35 | 22.1 | Horn nozzle 1.6 | 500 | 50 | Fresh water | D |

As shown in Table 1, the aluminum objects W (Test Nos. 1 to 4) were rated A showing high peening performance at the jet pressures of at least 15 MPa and not more than 35 MPa, which are lower than a jet pressure with a known technique. Notably, the high peening performance was also observed at the depth D of 200 mm (Test No. 4) from the liquid surface to the processing surface, which is lower than a depth with a known technique. For the object rated A, the depth d from the water surface to the nozzle lower end was 100 mm. The steel objects W were rated D independently of the depth d of 50 mm from the water surface to the lower end of the nozzle.

At a small depth with a known technique, the jet from the nozzle drew air from the liquid surface, causing less cavitation and thus degrading the peening performance. In contrast, at the jet pressure set to 15 to 35 MPa, which is lower than a jet pressure with a known technique, sufficiently high peening performance was achieved.

Subsequently, objects made of aluminum (A5052) underwent water jet peening tests using the underwater washing machine shown in FIG. 1 with a commercially available washing liquid containing an anticorrosive at temperatures within the range of 20 to 40° C. Table 2 shows the results. First, the water jet peening tests were conducted by producing a jet from the horn jet nozzle 10 shown in FIG. 2A with no flow straightener 15 shown in FIG. 2B, at the depth D of 200 mm from the liquid surface to the processing surface, the jet pressure of 7 to 35 MPa, and the depth d of 50 to 150 mm from the liquid surface to the nozzle lower end (Test Nos. 7 to 15). Additionally, water jet peening tests were conducted by producing a jet at the jet pressure of 7 to 40 MPa, the depth D of 80 to 300 mm from the liquid surface to the processing surface, and the depth d of 30 to 100 mm from the liquid surface to the nozzle lower end (Test Nos. 16 to 19). Then, water jet peening tests were conducted by producing a jet from the horn jet nozzle 10 including the flow straightener 15 (*1 in Table 2) at the depth D of 300 mm from the liquid surface to the processing surface (Test Nos. 20 to 22).

Further, water jet peening tests were conducted using the baffles 9A and 9B, which serve as the circulation obstructions 9 shown in FIG. 4 attached to the table 3 (*2 in Table 2) by producing a jet from the horn jet nozzle 10 at the depth D of 150 to 300 mm from the liquid surface to the processing surface and the depth d of 50 to 250 mm from the liquid surface to the nozzle lower end (Test Nos. 23 to 27). Also, water jet peening tests were conducted using the wide jet nozzle 20 shown in FIG. 3 (Test Nos. 28 and 29).

A first washing liquid is a diluted solution containing 3 wt % of detergent L-120A (Neos Corporation, an undiluted solution containing 10 to 20% in total of diethanolamine (less than 3%) and triethanolamine, less than 1% of a solubilizer, 10 to 20% of organic acid amine salts, less than 1% of a surfactant, less than 1% of an antiseptic, less than 3% of an anticorrosive, and 65 to 75% of water). A second washing liquid is a diluted solution containing 3 wt % of VP-W (Neos Corporation, an undiluted solution containing 3 to 10% of triethanolamine, 5 to 15% of organic acid amine salts, 10 to 20% of inorganic salts, 10 to 20% of an anticorrosive, and 45 to 55% of water). The nozzle choke diameter was appropriately selected from within the range of 1.4 to 2.1 mm in accordance with the jet pressure and the flow rate.

TABLE 2

| Test No. | Object (material) | Pressure (MPa) | Flow rate (L/min) | Nozzle type and diameter ø (mm) | Processing surface depth D (mm) | Nozzle depth d (mm) | Washing liquid | Rating |
|---|---|---|---|---|---|---|---|---|
| 7 | Aluminum | 35 | 22.1 | Horn nozzle 1.6 | 200 | 100 | First washing liquid | D |
| 8 | Aluminum | 35 | 22.1 | Horn nozzle 1.6 | 200 | 50 | First washing liquid | D |
| 9 | Aluminum | 15 | 24.9 | Horn nozzle 2.1 | 200 | 100 | Fresh water | A |
| 10 | Aluminum | 15 | 24.9 | Horn nozzle 2.1 | 200 | 150 | Second washing liquid | B |
| 11 | Aluminum | 15 | 24.9 | Horn nozzle 2.1 | 200 | 50 | Second washing liquid | C |
| 12 | Aluminum | 15 | 24.9 | Horn nozzle 2.1 | 200 | 100 | Second washing liquid | A |
| 13 | Aluminum | 7 | 28.2 | Horn nozzle 2.7 | 200 | 100 | Second washing liquid | D |
| 14 | Aluminum | 20 | 26.1 | Horn nozzle 2.0 | 200 | 100 | Second washing liquid | A |
| 15 | Aluminum | 35 | 22.1 | Horn nozzle 1.6 | 200 | 100 | Second washing liquid | B |
| 16 | Aluminum | 40 | 18.1 | Horn nozzle 1.4 | 100 | 50 | Second washing liquid | D |

TABLE 2-continued

| Test No. | Object (material) | Pressure (MPa) | Flow rate (L/min) | Nozzle type and diameter ø (mm) | Processing surface depth D (mm) | Nozzle depth d (mm) | Washing liquid | Rating |
|---|---|---|---|---|---|---|---|---|
| 17 | Aluminum | 30 | 20.4 | Horn nozzle 1.6 | 80 | 50 | Second washing liquid | D |
| 18 | Aluminum | 15 | 24.9 | Horn nozzle 2.1 | 100 | 30 | Second washing liquid | D |
| 19 | Aluminum | 7 | 9.9 | Horn nozzle 1.6 | 300 | 100 | Second washing liquid | D |
| 20 | Aluminum | 25 | 23.6 | Horn nozzle*1 1.8 | 300 | 100 | Second washing liquid | A |
| 21 | Aluminum | 15 | 24.9 | Horn nozzle*1 2.1 | 300 | 100 | Second washing liquid | A |
| 22 | Aluminum | 15 | 24.9 | Horn nozzle*1 2.1 | 300 | 130 | Second washing liquid | B |
| 23 | Aluminum | 25 | 23.6 | Horn nozzle*1 *2 1.8 | 250 | 150 | Second washing liquid | A |
| 24 | Aluminum | 30 | 20.4 | Horn nozzle*2 1.6 | 250 | 150 | Second washing liquid | A |
| 25 | Aluminum | 30 | 20.4 | Horn nozzle*2 1.6 | 200 | 50 | Second washing liquid | B |
| 26 | Aluminum | 30 | 20.4 | Horn nozzle*2 1.6 | 150 | 100 | Second washing liquid | A |
| 27 | Aluminum | 30 | 20.4 | Horn nozzle*2 1.6 | 300 | 250 | Second washing liquid | A |
| 28 | Aluminum | 15 | 14.5 | Wide nozzle 1.6*1 | 300 | 200 | Second washing liquid | A |
| 29 | Aluminum | 20 | 26.1 | Wide nozzle 2.0 | 200 | 100 | Second washing liquid | A |

*1 with flow straightener,
*2 with baffles
First washing liquid: L-120A, Second washing liquid: VP-W Although the peening performance was rated A in the water jet peening test (No. 9) using the underwater washing machine shown in FIG. 1 with fresh water at the low jet pressure of 15 MPa as in Table 1, almost no peening dents were formed in the water jet peening tests using the first washing liquid at the jet pressure of 35 MPa and the depth d of 100 and 50 mm from the liquid surface to the nozzle lower end (Nos. 7 and 8). In the water jet peening test using the second washing liquid at the jet pressure of 35 MPa, the peening performance was rated B showing high peening performance (No. 15), as in the test using the first washing liquid. Moreover, in the test using the second washing liquid at the jet pressure of 15 MPa and the depth d of 100 mm from the liquid surface to the nozzle lower end (No. 12), which is the same condition as in the test using fresh water (No. 9), the peening performance was rated A as in the test using fresh water. The peening performance was rated B at the depth d of 150 mm from the liquid surface to the nozzle lower end (No. 10), and was rated C at the depth d of 50 mm from the liquid surface to the nozzle lower end (No. 11).

The washing liquids with or without a surfactant are considered to have produced the different effects. The washing liquid containing a surfactant facilitates dissolution of air and obstructs cavitation. The second washing liquid containing no surfactant was determined to produce water jet peening performance equivalent to that of fresh water at the depth D of 200 mm from the liquid surface to the processing surface, which is smaller than a depth with a known technique.

When the water jet peening tests using the second washing liquid with different jet pressures were compared, the peening performance was rated high at jet pressures of 15 to 30 MPa (Nos. 12, 14, 20, 21, 23, 24, and 26 to 29), whereas a few peening dents were formed at the lower jet pressure of 7 MPa (Nos. 13 and 19) and the peening performance was rated D at the higher jet pressure of 40 MPa (No. 16).

For the high rating results achieved using the second washing liquid, the peening performance using the horn jet nozzle and the wide jet nozzle (Nos. 20 to 23 and 28) was rated high, or was rated A or B, at the relatively large depth D of at least 250 mm from the liquid surface to the processing surface, the relatively low jet pressure of not more than 25 MPa, with the flow straightener 15 shown in FIG. 2B as a cavitation stabilizer arranged upstream in the nozzle body. Notably, at the jet pressure of 25 MPa, the peening performance was rated A showing high peening performance, using the flow straightener 15 (Nos. 20 and 23). At the relatively high jet pressure of 30 MPa and with the baffles 9A and 9B placed to reduce liquid surface waves (Nos. 24, 26, and 27), the peening performance was rated A showing high peening performance, except when the depth d at the nozzle lower end is as small as 50 mm (No. 25, rated B).

The above results show that water jet peening is effectively performed with a water based washing liquid at the depth D of at least 100 mm to not more than 300 mm from the liquid surface to the processing surface, or more preferably at least 150 mm to not more than 250 mm. Thus, water jet peening is highly effective in a washing bath shallower than an existing water bath at the depth D of less than 300 mm, or specifically at the depth D of at least 150 mm and less than 300 mm, for example, at the depth D of not more than 250 mm. The jet pressure may be at least 15 MPa and not more than 35 MPa, or may be at least 15 MPa and not more than 25 MPa. The above results show that the performance is rated high, or rated A to C at the depth d of at least 50 mm and not more than 250 mm from the liquid surface to the lower end of the nozzle. This indicates that high peening performance can be achieved by downward jetting at a jet pressure lower than the pressure with a known technique and at a sufficiently large depth or at a distance from the liquid surface to the nozzle end.

Machine parts made of metal, such as an aluminum alloy or a ferroalloy, can corrode when immersed in pure water or in tap water. Under water jet peening in water, such machine parts can have their elements eluted into the liquid with time, and are damaged by corrosion.

The results in the present examples reveal that a washing liquid containing an anticorrosive is usable as a water based washing liquid containing no surfactant. Machine parts washed with the underwater washing machine using the washing liquid can then undergo peening using the same washing liquid and the same underwater washing machine.

When the constituents of the washing liquid that contribute to generation of a cavitation jet can be identified, a washing liquid containing such components may be selected or such components may be added to a washing liquid to provide high peening performance. Thus, machine parts made of an aluminum alloy can undergo water jet peening with high performance using the same washing liquid as used in the underwater washing machine for washing the machine parts. This further improves the work efficiency.

One component in the second washing liquid that can maintain to generation of a cavitation jet is triethanolamine. Amine compounds have been widely used as anticorrosives. An amine compound provides anticorrosive properties by providing an adsorption layer covering the metal surface with its polar part containing nitrogen to deposit on the metal surface and its other nonpolar chains facing outward. A water jet peening test was conducted using the underwater washing machine shown in FIG. 1 with a commercially available aqueous solution containing an amine compound alone without containing other components.

More specifically, a third washing liquid is a diluted solution containing 2.5 wt % of a pH improver (Neos Corporation, an undiluted solution containing 45 to 55% in total of amines, which are 40 to 45% of mono-n-propanolamine, and less than 10% of di-isopropanolamine, and 45 to 55% of water). A fourth washing liquid is a diluted solution containing 3 wt % of QUAKERCLEAN (trademark) 680VDA (Quaker Chemical Corporation, an undiluted solution containing 10 to 15% of monoethanolamine and 85 to 90% of water). The aluminum objects (A5052) then underwent water jet peening tests at the above optimal conditions, at the jet pressure of 15 and 20 MPa, the depth D of about 200 mm from the liquid surface to the processing surface, and the depth d of 70 to 155 mm from the liquid surface to the nozzle lower end (Test Nos. 30 to 33). Table 3 shows the test results.

TABLE 3

| Test No. | Object (material) | Pressure (MPa) | Flow rate (L/min) | Nozzle type and diameter ø (mm) | Processing surface depth D (mm) | Nozzle depth d (mm) | Washing liquid | Rating |
|---|---|---|---|---|---|---|---|---|
| 30 | Aluminum | 15 | 24.9 | Horn nozzle 2.1 | 200 | 100 | Third washing liquid | B*3 |
| 31 | Aluminum | 20 | 23.5 | Horn nozzle*2 1.9 | 250 | 150 | Third washing liquid | A |
| 32 | Aluminum | 15 | 35.3 | Horn nozzle*1 2.5 | 170 | 155 | Fourth washing liquid | C |
| 33 | Aluminum | 15 | 35.3 | Horn nozzle*1 2.5 | 170 | 70 | Fourth washing liquid | C |

*1with flow straightener,
*2with baffles,
*3discolored
Third washing liquid: pH improver, Fourth washing liquid: QUAKERCLEAN The test results in Table 3 show that the washing liquid containing amine compounds alone, such as the third or fourth washing liquid, can provide peening performance of a certain level or higher. Using the same third washing liquid, the performance was rated A showing high peening performance, when the baffles are used (No. 31) and the jet pressure, the processing surface depth D, and the depth d at the nozzle lower end were changed slightly from the corresponding conditions used in the test with the rating B (No. 30). Although these tests use two types of washing liquids containing amines alone without changing their concentrations, the use of other washing liquids with different conditions including the types of amine compounds or their concentrations may produce higher peening performance.

REFERENCE SIGNS LIST

1 underwater washing machine
2 washing bath
3 table
C washing liquid
W object (machine part)
4 washing liquid tank
5 washing liquid supply channel
6 piston pump
7 washing liquid supply valve
8 pressure transducer
9, 9A, 9B baffle (circulation obstruction)
9AR reinforcing rib
N cutout
10 jet nozzle (horn)
11 nozzle body
12 choke
13 nozzle bore
14 injection port
15 flow straightener
20 jet nozzle (wide)
21 nozzle body
22 choke
23 nozzle bore
24 injection port
30 recovery tank
31 centrifugal pump
32 filter
33 recovery channel
40 bath-washing liquid supply channel
50 drain channel
51 drain valve

What is claimed is:

1. A water jet peening method, comprising:

immersing an object in a water based washing liquid in a washing bath to have a processing surface at a distance of at least 100 mm and less than 300 mm from a liquid surface of the water based washing liquid; and jetting the water based washing liquid from a nozzle downward toward the object in the water based washing liquid contained in the washing bath, wherein the water based washing liquid is free of surfactant and contains an amine compound, jetting the water based washing liquid from the nozzle includes jetting the washing liquid at a jet pressure of at least 15 MPa and not more than 35 MPa, and jetting the water based washing liquid from the nozzle includes jetting the washing liquid while the nozzle has an end at a distance of at least 50 mm and not more than 250 mm from the liquid surface in the washing bath.

2. The water jet peening method according to claim 1, wherein jetting the water based washing liquid includes imparting compressive residual stress in the processing surface.

3. The water jet peening method according to claim 1, wherein the object comprises an aluminum alloy.

4. The water jet peening method according to claim 1, wherein jetting the water based washing liquid from the nozzle includes jetting the washing liquid while allowing a circulation obstruction to obstruct circulation of the washing liquid in the washing bath to reduce liquid surface waves.

5. The water jet peening method according to claim 2, wherein the object comprises an aluminum alloy.

6. The water jet peening method according to claim 1, wherein the water based washing liquid further contains an anti-corrosive.

* * * * *